United States Patent [19]

Zekich

[11] Patent Number: 4,586,441

[45] Date of Patent: May 6, 1986

[54] SECURITY SYSTEM FOR SELECTIVELY ALLOWING PASSAGE FROM A NON-SECURE REGION TO A SECURE REGION

[75] Inventor: Michael B. Zekich, Pasadena, Calif.

[73] Assignee: Related Energy & Security Systems, Inc., Evansville, Ind.

[21] Appl. No.: 386,291

[22] Filed: Jun. 8, 1982

[51] Int. Cl.[4] ..... E05G 3/00

[52] U.S. Cl. ..... 109/8; 109/6; 109/38; 382/2

[58] Field of Search ..... 109/3, 6–8, 109/21, 38–41, 43, 67; 340/572, 545; 382/2

[56] References Cited

U.S. PATENT DOCUMENTS

| | | | |
|---|---|---|---|
| 3,576,538 | 4/1971 | Miller | 382/2 |
| 3,648,240 | 3/1972 | Jacoby et al. | 382/2 |
| 3,750,158 | 7/1973 | Anastassakis | 109/7 |
| 4,060,039 | 11/1977 | Lagarrigue | 109/3 |
| 4,063,519 | 12/1977 | Pretini | 109/8 |
| 4,341,165 | 7/1982 | Calandritti et al. | 109/8 |
| 4,385,469 | 5/1983 | Scheuerpflug et al. | 109/8 |

FOREIGN PATENT DOCUMENTS

| | | | |
|---|---|---|---|
| 2448024 | 10/1980 | France | 109/3 |

OTHER PUBLICATIONS

"New Portable Explosives Detector–Intex Model J–7" and Model J–8 Pause Type Explosives Detector Intex, Inc., Bethesda, Maryland (First Production for Sale, Mar. 1981).

*Primary Examiner*—Kenneth J. Dorner
*Assistant Examiner*—Neill Wilson
*Attorney, Agent, or Firm*—Brady, O'Boyle & Gates

[57] ABSTRACT

A security system for allowing selective access to a secured area generally comprises first and second three wing center shaft ganged revolving door structures, each partially surrounded by upright facing curved side walls disposed in spaced apart relationship to define a mid-zone. A digital combination lock at the first entryway provides initial access. Any two wings of the revolving doors have an angular span less than that traversed by each side panel to define a lockable detection chamber. A gas ionization explosives detector is coupled to the detection chamber. The mid-zone comprises metal and X-ray detectors and a hand geometry reader. The second revolving door has an entryway actuatable by a pass card reader. The second revolving door provides access to the secure region.

In operation, an individual seeking access punches a combination lock releasing the first revolving door allowing the wings to rotate and then lock, enclosing a detection chamber in which the individual is confined. The explosives detector is actuated and samples air from the chamber to determine if explosives are present. A negative detection response releases the center shaft, the wings rotatable to a position allowing entry to the mid-zone. The individual then passes across the metal detector. Personal belongings are passed through the X-ray device. A badge, obtained at a guard station after palm reader identification, actuates the second revolving door, allowing access to the secure region.

19 Claims, 7 Drawing Figures

SECURITY SYSTEM FOR SELECTIVELY ALLOWING PASSAGE FROM A NON-SECURE REGION TO A SECURE REGION

BACKGROUND OF THE INVENTION

1. Field of the Invention

This invention relates to security systems. More particularly, the invention relates to integrated security systems for selectively allowing entry into a secure region upon positive determination of entry conditions.

2. Description of the Prior Art

In certain environments, high security is a necessity. The decision to either admit or reject an individual to a secure region may be based on a number of important separate identifiable elements of information concerning the person at the time entry is sought. To make this determination, a time consuming and expensive use of multiple guard stations may be required. Guards may be needed to monitor activity of the person seeking entry and to make various decisions. For example, is the person seeking entry carrying explosive devices or firearms? Has the actual identity of the person seeking entry positively been determined? Is the person leaving the region carrying radioactive material?

One of the problems with the use of multiple guard stations is the chance of human error. Consistency in obtaining sufficient accurate information is desirable. Various detector schemes have been used. Thus, radiation detectors and explosive detectors are not unknown. However, generally their use is accompanied by that of a number of guards. This involves significant costs while at the same time has inherent risks of human error. Vulnerability of guards to terrorists or corruption may also be a factor.

SUMMARY OF THE INVENTION

A security system in accordance with this invention generally includes a revolving door arrangement having a center shaft and upright wings extending radially from the center shaft. The revolving door arrangement defines a secure region and an access region. A detector coupled to the revolving door provides a signal defined by a person seeking access into the secure region. Means are responsive to the detector for allowing the rotation of the revolving door arrangement.

In a more specific example, the revolving door arrangement is movable to a confined locked position defining a chamber in which explosives detection takes place. When an individual seeking access is confined in the chamber, a sample of air in the chamber is drawn to a detector to determine concentrations of explosive components. Means are provided in response to the detector for allowing the further rotation of the door only if specific explosives threshholds are not met. Card reader access provides a verified identity allowing initial access to the chamber.

Additional features in accordance with this invention involve multiple revolving doors defining a mid-zone. The mid-zone is disposed in at least semi-secure relationship to a guard station. Access to the mid-zone is obtained after undergoing a first detection process through a first revolving door. However, access to the secure region may only be obtained by further security checks. Additional features in the mid-zone include a metal detector and a hand geometry reader. In some forms of the invention, the hand geometry reader provides a signal indicating the valid identity of the person seeking access to the secure region. The card reader access identity is compared to preenrolled hand geometry information to further confirm the identity to the individual seeking access. The floor of the confined chamber is weight responsive to provide an indication also compared to the identity provided by the card access to prevent simultaneous multiple entries and to further identify the individual seeking access. Indications of the various detection and identity tests are visable in the control panel of the guard station.

BRIEF DESCRIPTION OF THE DRAWINGS

A better understanding of the invention may be had by reference to the specifications taken in connection with the following drawings in which.

DETAILED DESCRIPTION

Figure 1:
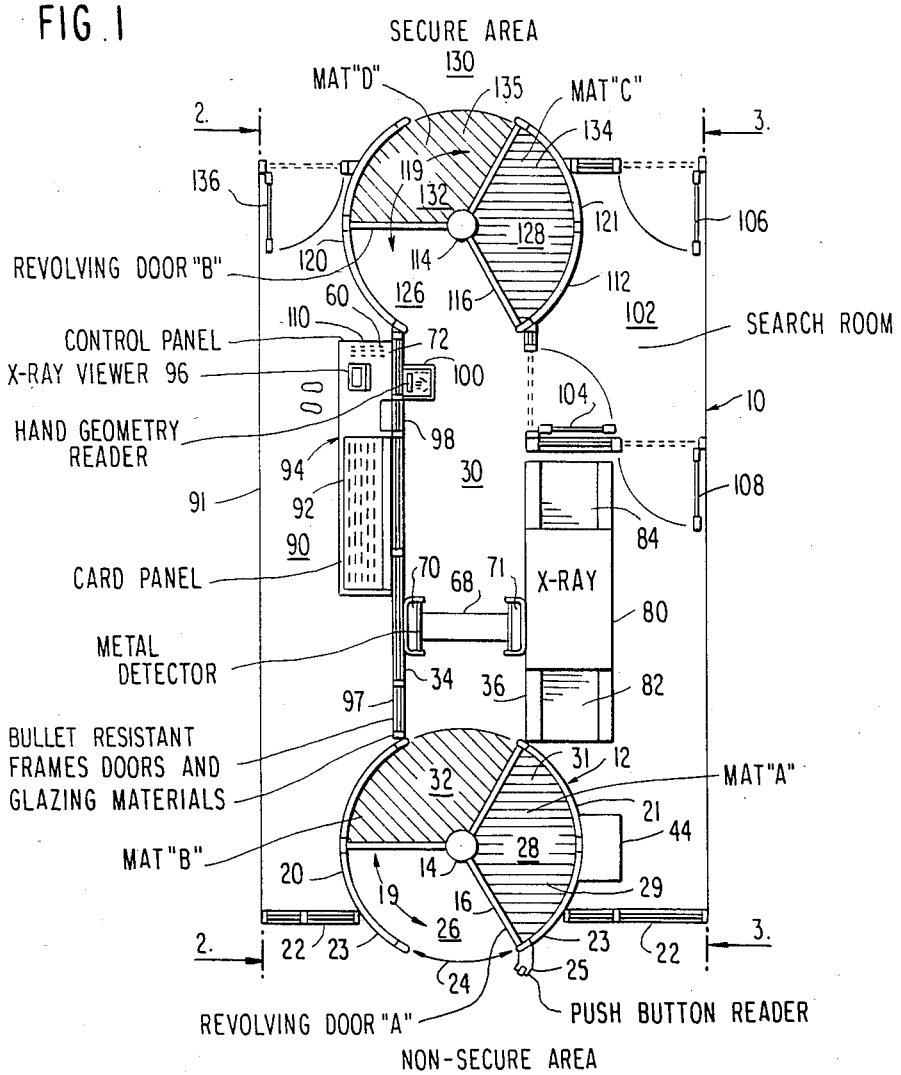
FIG. 1 is a diagramatic plan view of an entryway security system in accordance with this invention.
Figure 2:
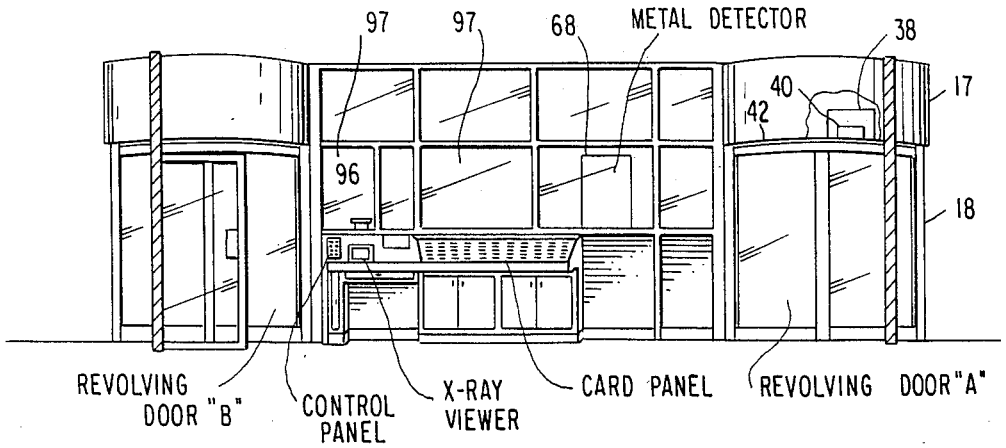
FIG. 2 is an elevational view of the invention taken along line 2—2 of FIG. 1.
Figure 3:
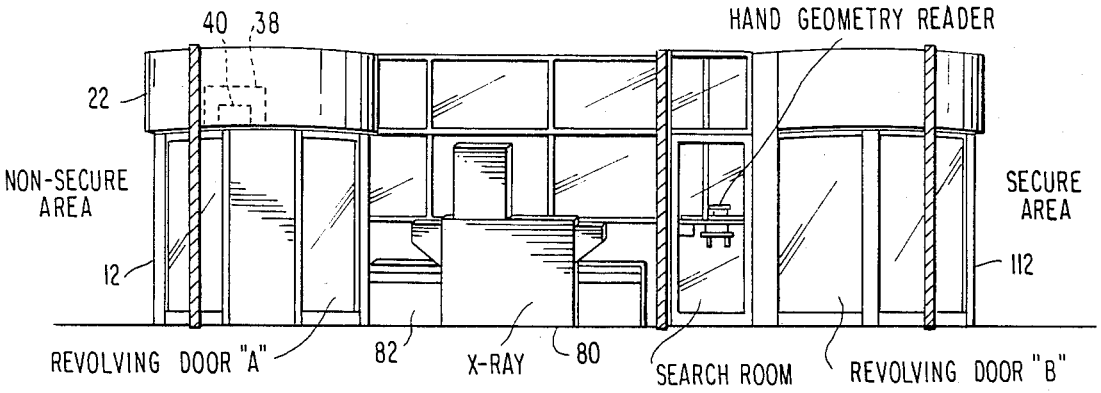
FIG. 3 is an elevational view of the invention taken along lines 3—3 of FIG. 1.

With particular reference to FIG. 1, FIG. 2, FIG. 3, FIG. 6 and FIG. 7, a security system 10 in accordance with this invention generally comprises a revolving door 12 having an upright vertical center shaft 14 moveable in response to a control logic arrangement 15 and three spaced apart upright wings 16 disposed circumferentially equidistant about and rotatable with the vertical center shaft 14. While the wings 16 are normally fixed to the center shaft 14 for ganged rotation, in some examples the wings 16 may be foldable or collapsable to provide an enhanced access for emergency situations. A drum 18 is provided for partially enclosing the wings 16 and a canopy 17 is disposed on top of the drum 18.

The drum 18 includes facing substantially semicircular curved panels 20, 21 partially enclosing the wings 16 and the center shaft 14 and defining a generally circular region 19. Extending outwardly on opposing sides of the curved panels 20, 21 are front walls 22 for preventing access. The forward portions 23 of the curved panels 20, 21 define a non-secure entryway 24, that is an area which when in use may be usually fully accessable to the public.

At the entryway 24 attached to the forward portion 23 of the panel 21, a pushbutton reader or card reader 25 is provided. Typically this is a combination digital lock which combination is known by authorized persons seeking access. In more sophisticated systems, logic is supplied to a computer to determine whether the individual has property authority for entry at the particular time and date. The card reader 25 is coupled to allow release of the center shaft 14 of the revolving door 12 to rotate 120°. An example of such a reader 25 is an Entrec Card Reader terminal provided by Entrec Systems, Harco Industries, Inc. of Phoenix, Ariz. Typcially, magnetically striped cards or badges are encoded with identifying information. The badge information combined with a pass code requiring a proper keystroke sequence further restricts access.

The three wings 16 of the revolving door 12 divide the generally circular region 19 between the curved panels 20, 21 into three moveable cylindrical segments having a cross section of constant equal area. The shaft 14 and thus the wings 16, though rotatable, lock into position when two of the wings 16 enclose the curved panel 21, defining three fixed segments. In some systems, locking is accomplished when utilizing a D.C. motor by applying a load to the windings, thereby regeneratively braking the motor. Alternatively, an electromagnetically engagable friction clutch may be used to brake the center shaft 14. A first segment 26 opens to the non-secure entry-way 24. The second segment 28 is completely closed off from access either with the non-secure entryway 24 or with a test corridor or mid-zone 30. The third segment 32 is open to the mid-zone 30, only. As a result of the wing spacing, an individual entering the first segment 26 is separated from any individual in the second segment 28 and is also separated from any individual in the third segment 32.

The mid-zone 30 is a semi-secure region bounded by a guard wall 34 extending from the curved panel 20 adjacent the third segment 32. A facing barrier 36 is disposed in parallel spaced apart relationship to the guard wall 34 and extends from the opposing curved panel 21. Typically the facing barrier 36 is 2 to 5 meters in length and here comprises a side of an X-ray detection device.

In the particular example shown here, an explosives detector 38 is coupled at the second segment 28. The explosives detector 38 is a pause type detector designed for screening personnel for possible concealed explosives based on the detection of explosive characteristic vapors. Analysis of an air sample from around the subject being screened is collected, concentrated and analyzed for polar nitrogen compounds in a gas chromatograph system. A fan 40 is disposed on the roof 42 of the revolving door 12 in the second segment 28. The fan 40 is designed to withdraw an air curtain from the chamber and thus away from any individual present in the chamber defined by the second segment 28. Helium is mixed with the air sample and is supplied from the gas bottle storage 44, typically at 60 psi. An example of such an explosives detector 38 for use in connection with this invention is a model J-8 detector manufactured by Intex, Inc. of Bethesda, Md. The detector 38 collects air from the chamber and samples the chemical composition. Dectection is accomplished by electron capture of heavy helium. An explosives indicator 60 having red and green visual indications is disposed behind the guard wall 34 for remotely displaying indications of explosive materials detected. An explosives threshhold signal is applied to the control logic 15 to cause appropriate actuation of the red and green light indicators.

In the second segment 28, a mat 29 covering a switch is provided for sensing the presense of an individual which signals a control panel lamp 50. Also, the mat 29 allows for weighing the individual on the mat. The mat 29 provides a platform for a pancake scale 31 such as a model WSCT available from Western Scale Co., Inc. of South Gate, Calif. The scale typically samples the weight at intervals of 4 times per second and provides an binary coded decimal output. This information may be used to verify identity to determine if the individual is carry excessively heavy objects. The coded information provided by the card reader 25 is correlated to a pre-enrolled weight so as to provide a reference. In the event the detected weight exceeds the individuals preenrolled weight by a predetermined tolerance, a signal is provided for locking the center shaft 14.

A metal detector 68 is disposed transverse to the path of the mid-zone 30 between the barrier 36 and the guard wall 34. The metal detector 68 typically employs a low inductance transmitter coil assembly 70 capable of short rise time pulse propagation. An example of a metal detector for use in connection with the systems described here is the Sentrie metal detection system of Intex, Inc. of Bethesda, Md. Such a system may use a phase lock master synchronous circuit to provide a system timing pulse train at a synchronous multiple of the power line frequency.

A sensing coil assembly 71 opposite the transmitter coil assembly 70 contains an even number of winding pairs connected so as to cancel interferring signals originating from external sources to significantly eliminate spurious alarms. Voltages are induced in these windings by the decay of pulse generated eddy currents in metal objects moving through the detection field.

Figure 6:
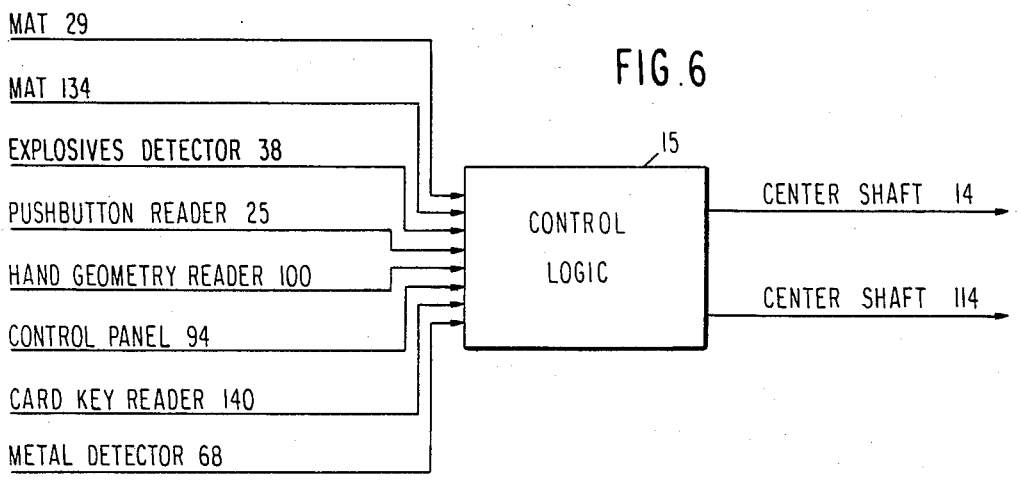
FIG. 6 is a block diagram illustrating an example of control logic input and output of the invention depicted in FIG. 1.

Transmittal pulse energy is eliminated from receiver circuits by time gating. After appropriate signal processing including both temporal and amplitude digital logic, the signal generated by a minimum mass or type and form of metal is applied to an alarm trigger circuit. The alarm trigger stage may be biased to a desired threshold by a sensitivity control. Also, as shown in FIG. 6, the metal detector is coupled as an input to the control logic 15. A panel lamp 72 responsive to the control logic 15 indicates the presense of suspect metal devices.

An X-ray detector 80 is disposed adjacent the barrier 36 and the metal detector 68 in the mid-zone 30. A conveyor 82 is disposed adjacent the curved panel 21 of the revolving door 12 in the mid-zone 30 in advance of the metal detector 68. The conveyor provides a means of passing objects through the X-ray detector 80. The conveyor 82 terminates in a receiving region 84 where materials which have been X-rayed may be retrieved.

On the opposite side of the mid-zone 30 adjacent the guard wall 34 is a guard room 90. The guard room 90 is bounded by a wall 91 and includes a card panel 92 for displaying pass cards for authorized persons. Also disposed in the guard room 90 is a control panel 94 and an X-ray viewer 96. The guard room 90 provides an area whereby the actions of those in the mid-zone 30 seeking entrance to the secure area may be monitored. That monitoring is aided in a variety of ways such as by the examination of X-ray detection, metal detection and personal identification. Bullet proof glazing 97 allows for direct visual observation. In some examples, it may be desirable to further separate the guard room from the mid-zone and observation in such case is then limited to the remotely displayed detection devices set forth herein, augmented by a closed circuit television system.

Adjacent to and extending from the guard room 90 is a pass window 98. This allows pass cards and papers to be passed back and forth from the mid-zone 30 to the guard room 90 while maintaining security between the adjoining regions. For example a passcard used to enter the first revolving door 12 may be submitted or an identification badge or pass card may be provided by the guard through the pass window 98.

Adjacent to the pass window 98 is a hand geometry reader 100. The hand geometry reader 100 includes an optical scanning device for obtaining a positive identification of the individual seeking to enter the secure area. An example of such a hand geometry reader is a model $T_1$ Identimat ® by Stellar Systems, A Wackenhut Company of 231 Charcot Avenue, San Jose, Calif. 95131. Aspects of that reader are described in U.S. Pat. Nos. 3,576,538 and 3,648,240. The system is typically used in conjunction with a magnetic card which contains an individuals hand geometry data. It is based on the premise that each individuals hand has a unique shape. The user hand geometry information is contained within the memory of a computer or the control logic 15. In order to identify the individual, the computer must be supplied with the individual's identification number. The card reader 25 provides initial identification of the individual seeking entry. Initially, a separate system may be used to "enroll" an individual for use of the system. In this enrollment mode, the individual will place their right or left hand on the device, depending on the information to be enrolled. The geometry information is correlated to create a better sample of hand geometry data.

Adjacent the mid-zone 30 is a search room 102. The search room 102 provides an area for shunting off individuals who have not passed the successive determinations required by the system. Access to the search room 102 from the mid-zone 30 is provided by a logic responsive shunt door 104. Examples of locking mechanisms for such a door are electrically powered dead bolts or electromagnetic locks such as are available from Security Engineering, Inc. of Forestville, Conn. These may be used in connection with standard swinging door hardware. A search room access door 106, similar to shunt door 104 provides access to and from the secure area to the search room. A service door 108 provides access to a back region of the X-ray detector 84 and the gas bottle storage 42.

The access door 106 and the service door 108 are locked when the shunt door 104 is open. Further, the shunt door 104 is locked when either the access door 106 or the service door 108 are open. These states are established by the control logic 15. This prevents the escape of an individual in the search room 102 or mid-zone 30 to the secure area 130. In some environments it may be desirable to automatically shunt an individual to the search room 102 if tests are not passed, without guard involvement to prevent collusion or compromise. The existence of a failure indication may be used to trigger the opening of the shunt door 104. An indicator 110 is provided on the control panel 94 to indicate the status of the doors 104, 106, 108.

A second revolving door 112 includes a center shaft 114, radially extending wings 116 disposed about the center shaft and generally circular concave curved panels 120, 121 disposed in a spaced apart facing relationship to provide entry access to the revolving door 112 and a secure region 130. The center shaft 114 is rotatable in a clockwise direction only and is responsive to the control logic 15.

As with the entry way revolving door 12, the secure region revolving door 112 has an upright vertical center shaft 114 and three spaced apart upright wings 116 disposed circumferentially equidistant about and rotatable with the vertical center shaft 114. The three wings 116 of the revolving door 112 divide the generally circular region 119 between the curved panels 120, 121 into three moveable cylindrical segments having a cross section of constant equal area. The shaft 114 and thus the wings 116, though rotatable, lock into position when two of the wings enclose the curved panel 121, defining three fixed segments. A first segment 126 maintains contact with the mid-zone entry way 124. The second segment 128 is completely closed off from access either with the mid-zone 30 or with the secure region. The third segment 132 is accessable to the secure region only. As a result of the wing spacing an individual entering the first segment 126 is separated from any individual in the second segment 128 and is also separated from any individual in the third segment 132. Access to segment 128 is available after the various mid-zone 30 tests have been completed and a card key reader 140 causes 240° rotation of the center shaft 114.

Weight sensitive mats 134, 135 are responsive to the presence of an individual are disposed at the bottom of the second and third segments 128, 132. An access door 136 is disposed adjacent the second revolving door 112 to allow entry to the guard room 98. This also allows a passage from the guard room 98 to the secure area to the search room 98.

Figure 4:
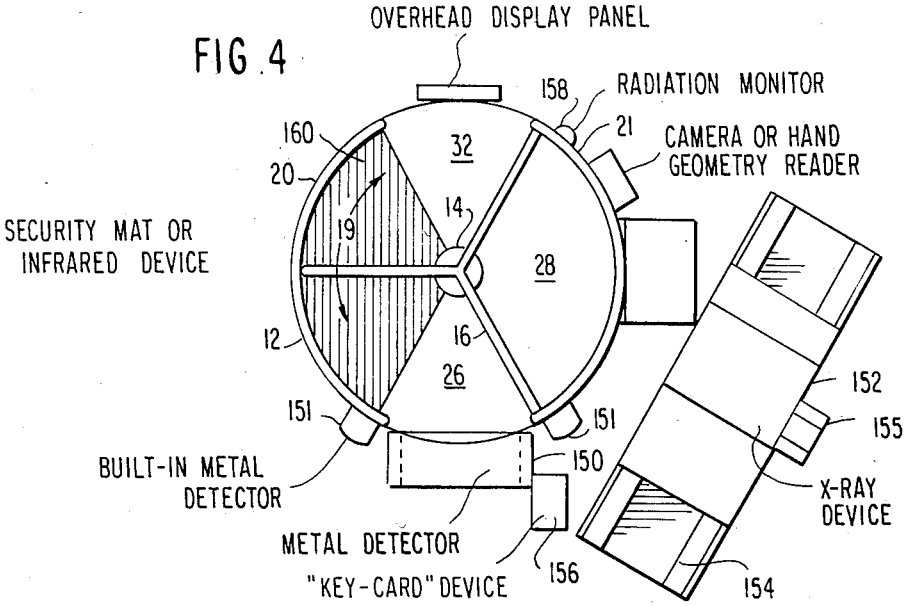
FIG. 4 is a plan view of a different security system in accordance with this invention.
Figure 5:
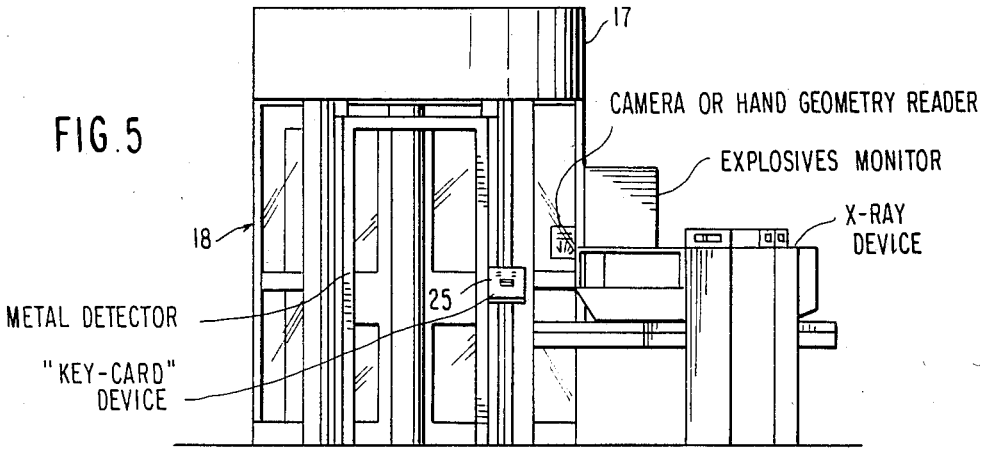
FIG. 5 is an elevational view of the invention depicted in FIG. 4.

With particular reference to FIGS. 4 and FIG. 5, a different security system in accordance with this invention comprises a single revolving door 12 having an upright vertical center shaft 14 and three spaced apart upright wings 16 disposed circumferentially equidistant about and rotatable with the vertical center shaft 14. A drum 18 includes facing substantially semi-circular curved panels 20, 21 partially enclosing the wings 16 and the center shaft 14 and defining a generally circular region 19, as in the prior example. Depicted in FIG. 4 is a freestanding metal detector 150 disposed at the entrance to the nonsecure entryway 24. Alternatively, a built-in metal detector 151 may be substituted for the freestanding metal detector 150. Adjacent the revolving door is an X-ray device 152 for checking of parcels and metal devices which are hand carried by the subject to be tested. The X-ray device has a conveyor 154 for transporting the parcels to be examined through an X-ray scanner 155.

Also at the entryway 24, is a card key device 156 or other controlled access device which upon insertion of card or key, the subject being tested will either be checked by the logic 15 to be accepted for entry at that time, for example with that particular day, month and year. Passing of this test will clear the subject for the metal detector test.

As in the previously described example of the system, the three wings 16 of the revolving door 12 sweep a generally circular region 19 between the curved panels 20, 21 and define three movable cylindrical segments having a cross-section of constant equal area. When two of the wings 16 enclose curved panels 21, segments 26, 28 and 32 become fixed. In a chamber defined by segment 28, the individual is tested by an explosives detector 38. In addition, a camera or hand geometry reader may be used in or communicating to the segment 28. In some installations, particularly when used in a reverse direction to control exit rather than entry, a radiation monitor 158 is desirable to determine if the individual is carrying any unauthorized radioactive material. The radiation monitor may also be coupled to the control logic 15. A mat 160 is used to sense the presense of an individual in an unauthorized region of the revolving door or attempting to move the revolving door in a reverse direction. Rotation of the door may be halted, for example, by an electromagnetic clutch, or regenerative braking.

In use, an individual seeking access to the secure area approaches the entry way 24 of the security system 10. The individual presses an appropriate combination code of the push button reader 25. If a logic determination is made that the code is correct, the center shaft 14 of the revolving door 12 is released and the individual can move the revolving door 12. In some examples, the revolving door will automatically rotate 120° and stop. The revolving door 12 is unidirectional and the individual may only move the revolving door 12 in a counter clockwise direction.

The revolving door 12 will move until the individual is in the second segment 28 and the two wings 16 in which the individual is surrounded by both engage the curved panel 21. The revolving door 12 again locks so that no further rotation of the shaft 14 may be made. Air is withdrawn from the test chamber above the segment 28 by the fan 40 and is sampled by the explosives detector 38. Visual detection of explosives may be examined by the explosives monitor 60. Should there be a detection of explosives, depending upon the particular configuration, the following will occur. The door 12 will rotate 120° , the shunt door 104 will unlock and the individual will be directed to the search room 102. In other examples, the revolving door 12 remains locked and secure. If no significant levels of explosive materials are detected then the shaft 14 rotates 120° so the individual may move into the third segment 32. The individual then has access to the mid-zone 30.

Figure 7:
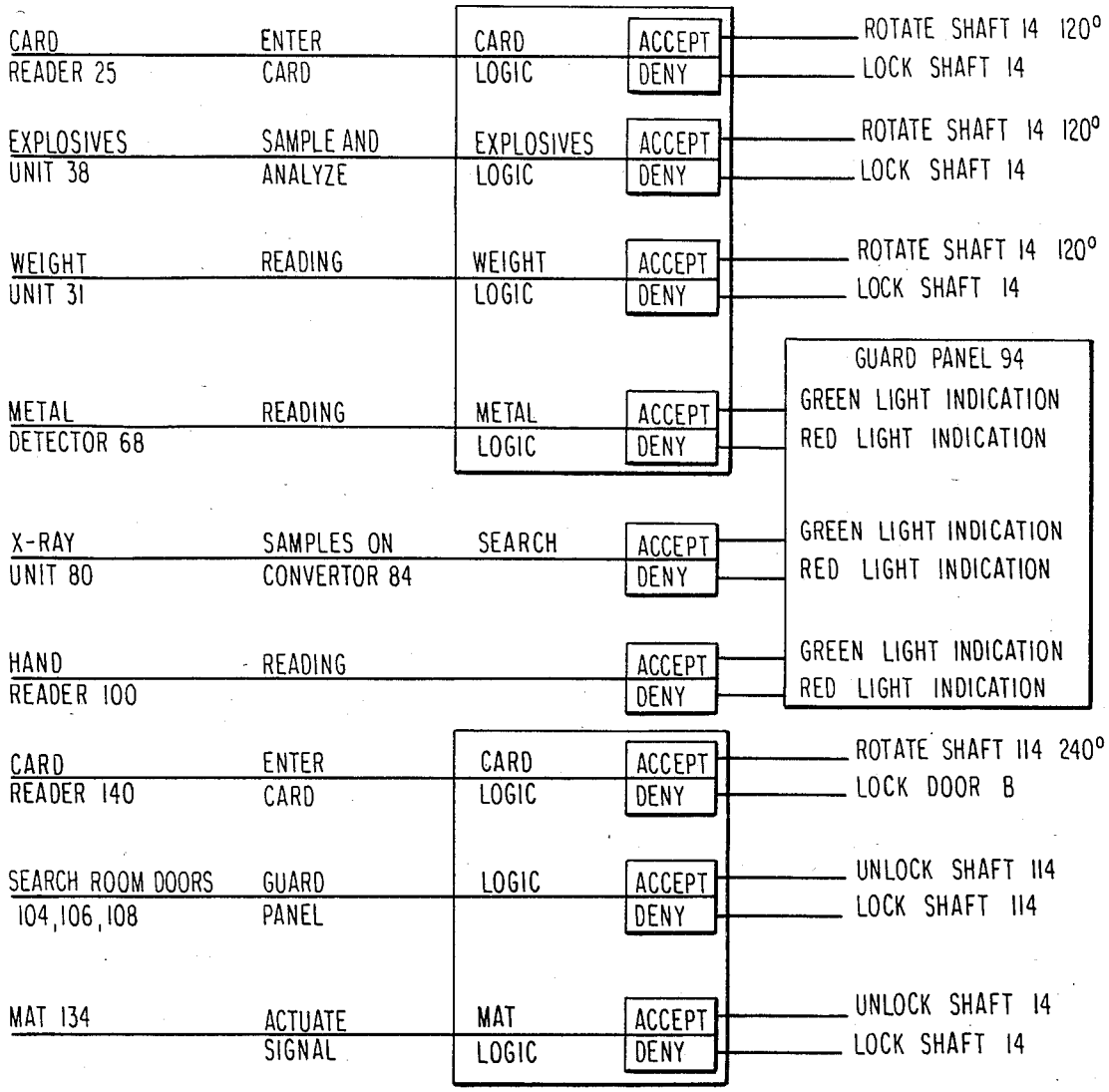
FIG. 7 is a schematic flow diagram for the system set forth in FIG. 1.

As shown in FIGS. 6 and 7, digital information from the card reader 25, the explosives unit 38, the weight unit 31 and the metal detector 68, are applied to the control logic 15. The control logic 15 receives input also from the mat 29, the mat 134, the control panel 94 and the card key reader 140. In order to enter the mid-zone 30, acceptable determinations must be made by the card reader, the explosives unit, and the weight detector. In any other event, access is denied and the shaft 14 of the first revolving door 12 is locked.

In the mid-zone 30, if the individual has any belongings, they are then placed on the conveyor 82 of the X-ray detector 80. The conveyor 82 passes through the X-ray detector 80 and the individual walks through the metal detector 68. Materials passed through the X-ray detector 80 are viewed at the X-ray viewer 96 in the guard room 90. If metal objects are detected by the metal detector 68 or if implements are detected by the X-ray detection device 80 at the X-ray viewer 96, the individual may then be shunted off from the mid-zone 30 to the search room 102.

Should the metal detection and X-ray devices prove negative then the individual may go to the guard station to obtain a pass at the pass window 98 and then have identification checked by the hand geometry reader 100. If the identification proves acceptable then the individual may place the pass on the card reader 140. If acceptable, the card reader 140 will allow rotation of the center shaft 114 of the revolving door 112 so that the wings 116 of the revolving door 112 may be rotated. Rotation for 240° occurs and then the shaft 114 locks. The mats 134, 135 detect the presence of the individual. When the individual leaves the mat 134, 135 for the secure area, an indication is sent to the control logic 15 to allow entry at the first revolving door 12.

Again, as shown in FIGS. 6 and 7, the metal detector 68, X-ray unit 80 and hand geometry reader 100 will cause appropriate accept or deny lamps to be actuated on the guard panel 94. In the event the shunt door 104 is open, the shaft 114 will be in a locked condition. Also, the mat 134 must not sense the presence of an idividual in order that the first revolving door shaft 14 be rotatable.

In some situations, only a single revolving door may be needed as illustrated in FIGS. 4 and 5 and only some of the detection features may be required. It should be appreciated that the systems described have minimized maintainance cost by limiting the number of guards. Automatic testing reduces the time needed to pass individuals through the system. Yet reliability is enhanced by minimizing subjective human determinations. The possibility of terrorist entry is low, as no guards are readily present to be taken hostage. This is further enhanced by the revolving door limiting one subject at a time to be tested. Thus only equipment damage would result, and time would be required to penetrate the equipment. Further, the subjective decisions are reduced preventing collusion or compromise of guards. While the invention has been shown and described with respect to particular examples thereof, it will be understood by those skilled in the art that various changes in form and details may be made therein without departing from the spirit and scope of the invention.

What is claimed is:

1. A security system for selectively allowing passage of an individual from a non-secure region to a secure region, comprising:

first revolving door means for selectively allowing passage of a person from the non-secure region to a mid-zone;

second revolving door means spaced apart from the first revolving door means for selectively allowing passage to a secure region;

mid-zone means for securely retaining and observing a person passed from the first revolving door means, the mid-zone means disposed between the first and second revolving door means; means for observing individuals in the mid-zone means, and a control panel physically separated from the mid-zone means, the control panel comprising an X-ray monitor for remotely viewing objects passed across the X-ray detection system in the mid-zone means; said control panel comprising a card panel and means for transferring cards from the card panel between the control panel and the mid-zone means.

2. The invention as set forth in claim 1 and in which:

the first revolving door means comprises a plurality of wings and center shaft means for allowing ganged wing rotation, the wings disposed radially about the center shaft, and spaced apart facing side panel means for partially surrounding the wings and defining an accessable entryway adjacent the non-secure region;

the wings movable to a locked position enclosing at least a portion of the side panel means and defining an enclosed detection chamber; and means for detecting the presence of an explosive substance disposed in communication to the chamber.

3. The invention as set forth in claim 2 and in which the explosive substance detection means comprises:

means for withdrawing air from the chamber; and means for sampling the chemical composition of the gas from the gas collecting means.

4. The invention as set forth in claim 3 and comprising means for monitoring an indication responsive to an explosive chemical composition of the air withdrawing means.

5. The invention as set forth in claim 4 and comprising means for locking the center shaft means in response to an explosives detection.

6. The invention as set forth in claim 2 and comprising radiation detection means.

7. The invention as set forth in claim 6 and comprising means for locking the shaft of the first revolving door in response to a detection of radiation.

8. The invention as set forth in claim 2 and comprising:

hand reader means for positively confirming the identity of an individual in the mid-zone means.

9. The invention as set forth in claim 8 and in which the second revolving door is responsive to the hand reader means to selectively prevent and allow rotation in responsive to negative and positive indentifications of the hand geometry reader means.

10. The invention as set forth in claim 2 and comprising weighing means for providing an indication responsive to the weight of an individual when in the the detection chamber.

11. The invention as set forth in claim 1 and comprising door means for diverting an individual from the mid-zone means to a secure search area.

12. The invention as set forth in claims 1, 2, 8, or 11 and comprising guard station means physically separated from the mid-zone means by bullet-proof glazing.

13. A security system for selectively allowing passage of an individual from a non-secure region to a secure region comprising:

first revolving door means for selectively allowing passage of a person from the non-secure region toward the secure region, the first revolving door means comprising a plurality of wings and center shaft means for allowing ganged wing rotation, the wings disposed radially about the center shaft, and spaced apart facing side panel means for partially surrounding the wings and defining an accessible entryway adjaent the non-secure region;

the wings movable to a locked position enclosing at least a portion of the side panel means and defining an enclosed detection chamber;

detection means for providing an indication in response to at least one security test on an individual passing through the system;

control logic means for allowing rotation of the center shaft means in response to security detection indications; second revolving door means spaced apart from the first revolving door means for selectively allowing passage to the secure region; mid-zone means for securely retaining and observing a person passed from the first revolving door means, the mid-zone means disposed between the first and second revolving door means; metal detector means for detecting suspect metal devices, the metal detector means coupled to the control logic for preventing rotation of the second revolving door means in response to the presence of suspect metal devices; weighing means responsive to the weight of an individual in the first revolving door means, the wing means coupled to the control logic means; and hand geometry reader means disposed within the mid-zone for identifying an individual, the hand geometry reader means coupled to the control logic means.

14. The invention as set forth in claim 13 and comprising explosives detection means for sensing explosive chemical compositions in the confined chamber.

15. The invention as set forth in claim 13 and comprising:

search room means for manually conducting security checks on an individual in a region physically separated from the mod-zone, the search room means selectively accessible from the mid-zone means;

shunt door means for selectively allowing entry of an individual to the search room means from the mid-zone means; and access door means for selectively allowing entry of an individual from the secure area to the search room means.

16. The invention as set forth in claim 15 and in which the shunt door means is responsive to the control logic so as to lock when the access door is unlocked.

17. The invention as set forth in claim 15 and comprising means for unlocking the search room door in response to an indication representing a failure to pass at least one security test.

18. The invention as set forth in claim 15 and comprising:

mat means for sensing the presence of an individual, the mat means disposed about the second door means and adjacent the secure region; and means for releasing the first revolving door means in response to an indication that no individual is present on the mat means, thereby preventing entry to the mid-zone from the non-secure area until any previously entering individual seeking entry to the secure region has passed to the secure region.

19. The invention as set forth in claim 15 and in which the guard room means is physically spaced apart from the mid-zone and comprising closed circuit television means for remotely observing individuals in the mid-zone.

* * * * *